United States Patent [19]

Driggers

[11] 4,186,707

[45] Feb. 5, 1980

[54] FUEL ECONOMIZER SYSTEM FOR INTERNAL COMBUSTION ENGINES

[76] Inventor: Vernon J. Driggers, P.O. Box 64, Scranton, S.C. 29591

[21] Appl. No.: 899,405

[22] Filed: Apr. 24, 1978

[51] Int. Cl.[2] ..... F02B 1/02

[52] U.S. Cl. ..... 123/139 AV; 123/140 MP; 251/61; 251/309; 261/69 R

[58] Field of Search .... 123/140 R, 140 MP, 139 AV; 251/61, 309; 261/34 A, 69

[56] References Cited

U.S. PATENT DOCUMENTS

| | | | |
|---|---|---|---|
| 634,242 | 10/1899 | Lambert | 261/65 |
| 1,132,850 | 3/1915 | Huff | 137/351 |
| 1,196,976 | 9/1916 | Pembroke | 137/351 |
| 1,518,906 | 12/1924 | Edwards | 123/139 AV |
| 2,881,789 | 4/1959 | Finazzo | 137/359 |
| 3,521,856 | 7/1970 | Smith | 251/309 |
| 3,674,238 | 7/1972 | Pickles et al. | 251/309 |
| 3,724,435 | 4/1973 | Bier | 123/139 AV |
| 3,724,823 | 4/1973 | Littlemales | 123/140 MP |
| 3,873,649 | 3/1975 | Cleary | 251/309 |
| 4,044,744 | 8/1977 | Keefer | 123/139 AV |
| 4,052,490 | 10/1977 | Fedison | 26/34 A |

FOREIGN PATENT DOCUMENTS

| | | | |
|---|---|---|---|
| 2507307 | 9/1975 | Fed. Rep. of Germany | 123/139 AV |

OTHER PUBLICATIONS

American Parts Catalog, 1978, p. 50.

J. C. Whitney & Co. Catalog, Series 373; 1978, p. 16.

*Primary Examiner*—Charles J. Myhre

*Assistant Examiner*—Craig R. Feinberg

*Attorney, Agent, or Firm*—Luke J. Wilburn, Jr.; Wellington M. Manning, Jr.

[57] ABSTRACT

A fuel economizer system for an internal combustion engine comprising a fuel supply tank, a main fuel supply line connecting the tank to the carburetor of the engine, and a fuel pump in the supply line for delivering fuel to the carburetor, an adjustable fuel metering valve positioned in the fuel supply line between the fuel pump and the carburetor, and means for automatically adjusting the metering valve in response to changes in load conditions on the engine to provide minimum fuel pressure and fuel to the carburetor inlet during idle and no-load conditions, while increasing the fuel pressure and amount of fuel supplied to the carburetor in response to increases in the load condition on the engine. During operation of the engine, the position of the metering valve is automatically adjusted by a diaphragm motor which is operatively connected to the intake manifold of the engine whereby changes in vacuum pressure in the intake manifold move the valve to increase or decrease the supply of fuel to the carburetor. The metering valve includes a rotary valve plug having a generally rectangular fuel passageway therethrough which is rotatably positioned from a full open condition during acceleration and heavier load conditions on the engine, to a maximum, partially closed condition during idle and minimum load conditions on the engine.

8 Claims, 5 Drawing Figures

FUEL ECONOMIZER SYSTEM FOR INTERNAL COMBUSTION ENGINES

The present invention relates to a fuel economizer system for internal combustion engines, and, more particularly, to a fuel supply system which includes an automatically adjusted metering valve positioned in the fuel supply line to the engine between the fuel pump and the carburetor to maintain a preselected low fuel supply pressure to the carburetor at all times except during periods of load on the engine, thereby appreciably reducing overall gas consumption without appreciably effecting performance characteristics of the engine.

Due to decreasing availability and increasing expense of petroleum fuels, as well as the increasing public awareness of the environmental polution due to by-products of combustion of such fuels, there is a continuous effort to improve the efficiency of fuel consumption in internal combustion engines. In particular, the automotive industry, with the assistance of federal requirements, is ever seeking ways to increase gas consumption efficiency and minimize environmental contamination from the by-products of fuel combustion in the automobile engine.

With such objects in mind, the present invention is directed to a fuel economizer system for internal combustion engines, particularly of the type employed in automobiles and other motor vehicles. In its broad aspects the invention comprises a fuel supply system having an automatically adjusted metering valve located in the main fuel supply line of an automobile between the fuel pump and the inlet to the carburetor to provide a lower fuel pump pressure and correspondingly less fuel to the carburetor and engine of the automobile during idle and normal load driving conditions while automatically providing higher fuel pump pressures and more fuel to the carburetor and engine as higher engine output is required, e.g., during periods of acceleration and when increased load is placed on the engine. More particularly, the metering valve is automatically adjusted in response to changes in engine load conditions which are reflected by changes in vacuum pressure in the intake manifold of the engine.

In the preferred embodiment of the invention as hereinafter described, the metering valve in the fuel line between the fuel pump and carburetor comprises a rotary valve having a valve plug with generally rectangular cross-sectional fuel flow passage therethrough. The valve is rotatably adjusted by a diaphragm motor connected to the valve stem which communicates by vacuum line to an intake manifold vacuum fitting on the engine.

In a conventional automobile fuel system, fuel is supplied from the fuel tank to the carburetor of the engine by means of a fuel pump located in the fuel line. The pump is designed to provide fuel at all times under constant pressure to the carburetor fuel bowl, and the amount of fuel in the bowl is controlled by an inlet needle valve and float system. As fuel is supplied in metered amounts from the bowl to the venturi section of the carburetor for mixture with air before passing into the engine intake manifold, the bowl is refilled with fuel under a constant pressure from the fuel pump. Since periods of acceleration and heavier load on the engine require a faster supply of fuel to the engine, the constant pressure of the fuel pump must be necessarily high enough to satisfy these peak fuel supply requirements.

Due to the high fuel pump pressures required for heavy load constructions, I have discovered that the fuel pump delivers more fuel to the carburetor at idle and no-load conditions than is required by the engine. This excess supply of fuel to the carburetor decreases the fuel consumption efficiency of the engine and produces greater non-combusted by-products of fuel combustion in the engine exhaust.

It is therefore a primary object of the present invention to provide a fuel economizer system whereby the fuel supplied to the carburetor during normal-load and idle conditions is greatly reduced to increase the fuel consumption efficiency, while greater amounts of fuel are automatically supplied to the carburetor during acceleration and increased load conditions on the engine, when required.

The invention will be better understood, and other objects thereof will become more apparent, from the following detailed description of a preferred embodiment of the invention, as illustrated in the accompanying drawings, in which.

Figure 2:
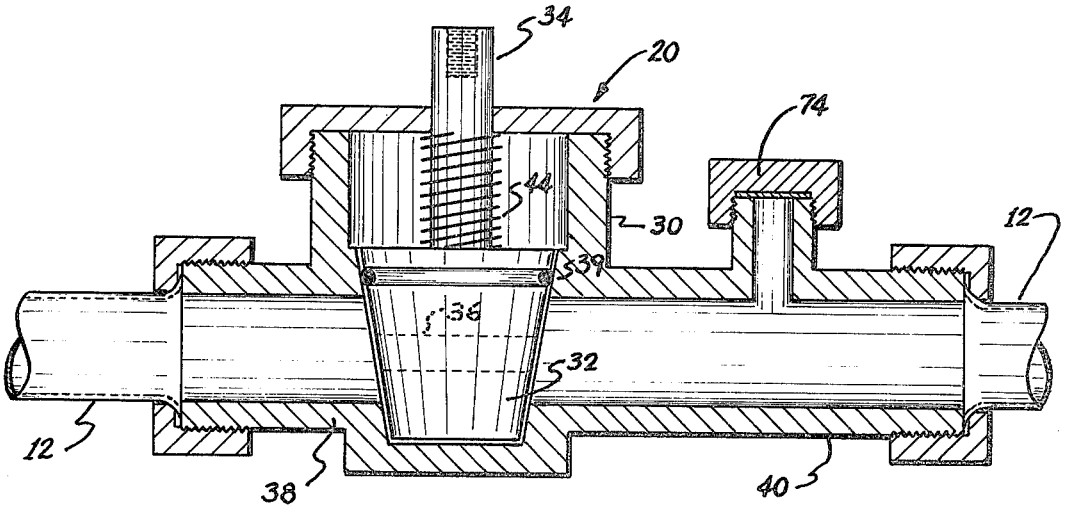
FIG. 2 is a cross-sectional elevational view of the automatically adjusted metering valve of the present invention illustrated diagrammatically in FIG. 1.
Figure 3A:
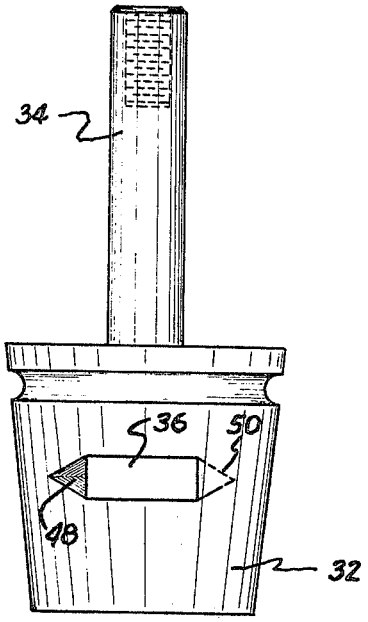
Figure 3B:
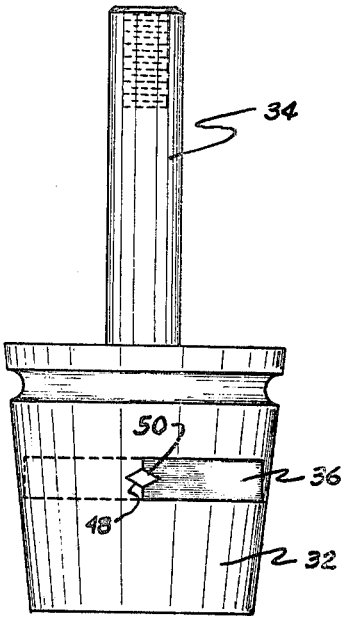
Figure 4:
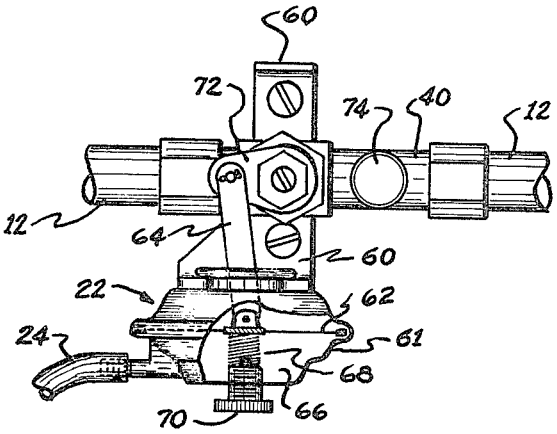

FIGS. 3*a* and 3*b* are right side elevation views of the valve plug of the metering valve of FIG. 2; and FIG. 4 is a plan view of the valve of FIG. 2 showing partially in section, a diaphragm motor which adjusts the position of the valve plug of the metering valve in response to changes in vacuum pressure in the intake manifold of the engine.

Figure 1:
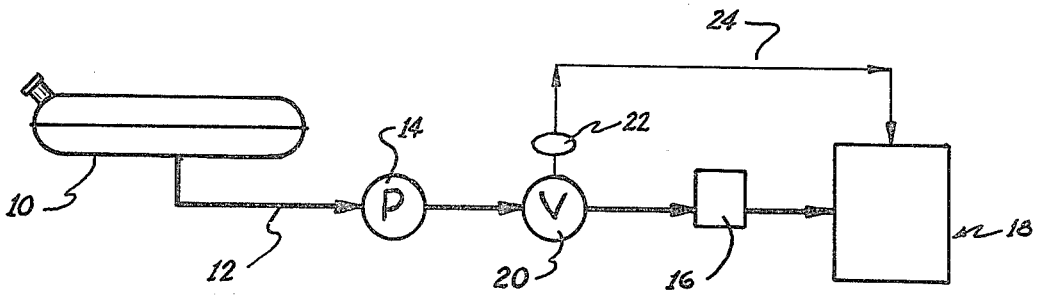
FIG. 1 is a diagrammatic drawing of a fuel supply system for an internal combustion engine employing the present invention.

Referring more particularly to the drawings, FIG. 1 shows diagrammatically a fuel supply system for an automobile internal combustion engine which includes a fuel tank 10, a main fuel supply line 12, a fuel pump 14 located in the supply line to provide fuel under pressure to a carburetor 16 of an internal combustion engine 18. The fuel pump 14 is of conventional construction and operates in conventional manner to supply fuel to the fuel bowl, or reservoir, of the carburetor under a predetermined constant pressure sufficient to supply enough fuel to the engine for maximum fuel consuming conditions, i.e., under heaviest load conditions which the engine can be expected to incur. As a typical example, in a 400 cubic inch, 300 horsepower Cheverolet engine with a four barrel carburetor, the fuel pump is designed to provide 7 to 8½ pounds per square inch constant fuel pressure to the carburetor.

As seen in FIG. 1, located between fuel pump 14 and carburetor 16 in fuel supply line 12 is an automatically adjusted pressure regulating valve 20 of the present invention. To control the amount of fuel and pressure of the fuel reaching the inlet of the carburetor, the valve is operatively connected to a diaphragm motor 22 which is in turn operatively connected by means of a vacuum line 24 to a vacuum fitting on the intake manifold of engine 18, as will be explained in more detail hereinafter.

Referring to FIG. 2, the fuel metering valve 20, in its preferred embodiment, comprises a valve body, or housing 30 containing a rotatable, generally frusto-conical valve plug 32 having a valve stem 34. As seen in FIGS. 2 and 3*a*, the valve plug has a generally rectangular cross-sectional passageway 36 therethrough. As illustrated in FIG. 2, pipe end 38 of the valve housing is connected to the portion of fuel line 12 leading from the fuel pump, and the opposing pipe end 40 is connected to the portion of fuel line 12 leading to the carburetor. Valve plug 32 has a peripheral groove with flexible O-ring 39 to seal the valve against fuel loss, and valve plug 32 is urged downwardly against the housing valve seat by a spring 44 surrounding the valve stem in the upper portion of the valve housing.

As best seen in FIG. 3*a*, the passageway 36 through valve plug 32 is of generally rectangular cross-sectional configuration, and is of the same internal cross-sectional area as the internal cross-sectional area of the main fuel line 12 to permit unrestricted flow of fuel from the fuel pump to the carburetor when the valve is fully open, as shown. Opposite sides of opposite ends of the passageway are further provided with tapered or V-shaped notches 48, 50. Thus, by rotating the valve stem and valve plug only approximately ¼ of a turn in the valve housing, the valve can be effectively utilized to accurately and precisely meter the flow of fuel through the valve from a full open position (FIG. 3*a*), to an almost closed position, as shown in FIG. 3*b*. By tapering the opposite sides of the passageway in a V-shaped configuration, accurate metering of very small amounts of fuel to the carburetor can be accomplished.

The automatic positioning of the valve plug of the metering valve may best be described by reference to FIG. 4 which is a plan view of the valve of FIG. 2 showing in partial sectional view, diaphragm motor 22 which is supportably attached to the valve by suitable means, such as a metal bracket 60 and fastening elements. As shown diaphragm motor 22 is of conventional construction and comprises a housing 61 containing a flexible diaphragm element 62 having an operating lever arm 64 attached thereto. Movement of diaphragm element 62 moves the lever arm 64 inwardly in response to an increase in vacuum in diaphragm compartment 66, and a spring 66 urges the diaphragm element and lever arm in an outward direction in response to a decrease in vacuum in compartment 66. The extent of inward movement of the lever arm 64 and diaphragm element 62 is controlled by an adjusting screw 70 extending through spring 68. Diaphragm compartment 66 is connected by means of vacuum line 24 to a vacuum fitting on the inlet manifold of the engine 18 (FIG. 1).

To operate the metering valve 20, outer end of diaphragm lever arm 64 is pivotally connected to a second lever arm 72 attached by fastening means to the upper end of valve stem 34. Thus, movement of diaphragm element 62 in response to changes in vacuum pressure in diaphragm compartment 66 causes rotation of the valve plug from a fully open position, as shown in FIG. 3*a*, to a partially closed position the maximum extent of which is established by adjustment of screw 70 of the diaphragm motor. When there is little or no vacuum on the engine intake manifold and correspondingly on diaphragm compartment 66, diaphragm element 62 is urged by spring 68 to a generally central position in the diaphragm motor, and lever arms 64, 72 rotate the valve plug to a fully open position. As partial vacuum is drawn on the diaphragm compartment 66 in response to increase in vacuum in the engine intake manifold, the diaphragm element and diaphragm lever arm are drawn inwardly to rotate the valve plug to a partially closed position.

Since highest vacuum on the intake manifold of an internal combustion engine occurs during idle and no-load conditions, while minimum vacuum exists during acceleration and increased load on the engine, adjusting screw 70 of the diaphragm motor may be positioned during idle of the engine to establish the maximum partially closed position of the valve, thereby reducing the fuel pressure and corresponding amount of fuel supplied to the carburetor during idle and no-load conditions on the engine. It is believed that for most automobile passenger car engines, a minimum fuel pressure of approximately one pound per square inch at the carburetor of the engine is sufficient to supply the fuel necessary for proper operation of the engine at idle and no-load conditions. Therefore, to set the maximum partially closed position of the valve, the metering valve is provided with a test port and fitting 74 on the fuel outlet side of the valve to which a pressure gauge may be attached to determine the pressure of the fuel at the carburetor during idle of the engine.

The operation of the fuel economizer system of the present invention is described as follows. Metering valve 20 with diaphragm motor 22 is positioned in the main fuel line 12 between the fuel pump and the carburetor at any convenient location. With the automobile engine at idle, a pressure gauge is attached to the test port fitting 74 of the valve and the diaphragm adjusting screw positioned to obtain a minimum pressure reading on the gauge which still provides sufficient fuel to the carburetor and engine to maintain proper idle conditions. As previously mentioned, it has been found that for most automobile passenger car engines, fuel pressure of approximately one pound per square inch is sufficient to insure proper idle of the engine; however, the maximum partial closure of the metering valve may be varied by the diaphragm motor adjusting screw to obtain the proper minimum pressure and the fuel supply, depending upon the particular requirements of the internal combustion engine and fuel supply system in which the valve is to be employed. During operation of the engine, the metering valve is thus automatically positioned in response to changes in vacuum in the intake manifold of the engine to provide minimum fuel pressure and amounts of the carburetor during idle and no-load condition on the engine, while automatically opening in response to a decrease in vacuum pressure on the engine intake manifold during periods of acceleration and heavier load conditions, thus ensuring sufficient fuel pressure and fuel flow to the carburetor and engine at all times.

To determine the effectiveness of the fuel economizer system of the present invention, tests were conducted on a 1971 Cheverolet having a 400 cubic inch, 300 horsepower engine utilizing a 4 barrel carburetor and a fuel pump designed to deliver fuel to the carburetor at a constant pressure of seven to eight and one-half pounds per square inch. Under various road driving conditions utilizing the metering valve set with a maximum partially closed setting to deliver fuel at a one pound per square inch fuel pressure to the carburetor at idle, fuel consumption over an approximately 60 mile distance averaged 16.5 miles per gallon. The metering valve was removed from the fuel line and the automobile driven over an approximately 60 mile distance under similar driving conditions, and fuel consumption over such distance averaged 10.9 miles per gallon.

To determine the amount of non-combusted materials emitted from the exhaust system of the automobile described above, the exhaust system was connected to a Sun Infra Red Test Machine of a type well known in the automotive industry. Tests were conducted and data accumulated at various speeds of revolution of the engine with and without the use of the metering valve of the present invention. The results of these tests are presented in the following table.

TABLE

| Engine Speed | Hydrocarbons, in Parts per Million in Engine Exhaust | % Carbon Monoxide in Engine Exhaust |
|---|---|---|
| WITH METERING VALUE IN FUEL LINE | | |
| 700 RPM | 125 | 2.5 |
| 1500 RPM | 75 | 2.0 |
| 2500 RPM | 50 | 1.8 |
| WITHOUT METERING VALVE IN FUEL LINE | | |
| 700 RPM | 190 | 4.5 |
| 1500 RPM | 210 | 6.5 |
| 2500 RPM | 150 | 4.0 |

As can be seen from the foregoing test results, operation of the automobile engine with the fuel economizer system of the present invention greatly reduces the amount of hydrocarbons and carbon monoxide in the engine exhaust as compared to the conventional fuel system of the automobile, thus greatly reducing the emission of polutive by-products of combustion of the engine and increasing the fuel economy of the engine.

Although the herein described preferred embodiment of the invention provides control of the metering valve by vacuum pressure on the intake manifold of the engine, other means may be employed to regulate the valve to provide improvement in fuel consumption economy. Improved results have also been obtained by controlling the position of the valve directly from the accelerator pedal of the automobile through mechanical linkage, and it is contemplated that the valve may be controlled electrically to provide automatic adjustment of the valve in response to changes in the load condition requirements on the engine.

That which is claimed is:

1. In a fuel supply system for an internal combustion engine including a fuel supply tank, a fuel supply line connecting the tank to the fuel inlet of the carburetor of the engine, and a constant pressure fuel pump in the supply line between the tank and the carburetor for delivering fuel to the inlet of the carburetor; the improvement therein comprising a fuel metering valve positioned in the fuel line between the fuel supply pump and the inlet to the carburetor, means for automatically adjusting the metering valve between fully open and only partially closed positions in response to changes in load on the internal combustion engine to reduce the fuel pressure and flow to the inlet to the carburetor during idle and no-load operating conditions on the engine to a minimum preselected amount while progressively increasing the fuel pressure and flow to the carburetor to a maximum flow and pressure in response to increasing load conditions on the engine, and wherein said means for automatically adjusting the metering valve includes means for selectively setting the maximum amount of closure of said valve to establish said minimum preselected amount of fuel pressure and flow during idle and no-load operating conditions.

2. A fuel supply system as defined in claim 1 wherein said metering valve comprises a valve housing having fuel inlet and fuel outlet ends respectively connected to said fuel supply line leading from said fuel pump and to said carburetor, a rotary valve plug in said housing having a substantially rectangular cross-sectional fuel flow passage therethrough, said plug being rotatable in said housing from a fully open fuel flow condition to a partially closed fuel flow condition in response to said automatic adjusting means therefor; the cross-sectional area of said rectangular fuel flow passage through said plug being substantially equal to the internal cross-sectional area of said fuel supply line.

3. A fuel supply system as defined in claim 2 wherein an opposite side portion of each end of said rectangular fuel flow passage in said valve plug is of generally tapered V-shaped configuration to facilitate precise metering of small amounts of fuel through said valve when said valve is in said partially closed position.

4. A fuel supply system as defined in claim 3 wherein said valve plug is rotatable from fully open to substantially closed position by approximately ¼ revolution of said valve plug in said valve housing.

5. A fuel supply system as defined in claim 1 wherein said means for automatically adjusting the metering valve comprises diaphragm motor means operatively connected to the valve and to the intake manifold of the engine to move said valve from a fully open fuel flow position during minimum and no vacuum pressure in the intake manifold to a predetermined maximum partially closed position during maximum vacuum pressure in the intake manifold of the engine.

6. A fuel supply system as defined in claim 5 wherein said diaphragm motor means comprises a diaphragm housing, a flexible diaphragm element mounted in said housing for movement and defining with said housing a pressure sensitive compartment, an operating lever arm attached to said diaphragm element and moveable therewith in response to changes in vacuum pressure in said compartment, said lever arm being operatively connected to said valve to move said valve between said fully open and said only partially closed position in response to movement of said flexible diaphragm element, and means communicating said diaphragm compartment with the intake manifold of said engine whereby changes in vacuum pressure occuring in said intake manifold correspondingly move said valve between said fully opened and said only partially closed position.

7. A fuel supply system as defined in claim 6 wherein said metering valve comprises a valve housing, a rotatable valve plug mounted for rotation in said housing between said fully open and said only partially closed position, said valve plug having a generally rectangular cross-sectional fuel flow passage therethrough, a valve stem on said valve plug, and lever arms means attached to said valve stem and operatively connected to said operating lever arm of said diaphragm motor means whereby movement of said diaphragm element causes rotation of said valve plug between said fully open and said only partially closed position in said valve housing.

8. A fuel supply system as defined in claim 7 wherein said valve plug is rotatable from said fully open to said partially closed position by approximately ¼ revolution of said valve plug in said valve housing.

* * * * *

UNITED STATES PATENT AND TRADEMARK OFFICE

CERTIFICATE OF CORRECTION

PATENT NO. : 4,186,707

DATED : February 5, 1980

INVENTOR(S) : Vernon J. Driggers

It is certified that error appears in the above-identified patent and that said Letters Patent are hereby corrected as shown below:

Column 2, line 2, "constructions" should read--conditions--.

Column 3, line 38, "66" should read--68--.

Column 4, line 41, "of" should read--to--.

Column 6, line 53, "arms" should read--arm--.

Signed and Sealed this

*Sixth* Day of *May 1980*

[SEAL]

*Attest:*

SIDNEY A. DIAMOND

*Attesting Officer*

*Commissioner of Patents and Trademarks*